US007503718B2

(12) United States Patent
Hamada

(10) Patent No.: US 7,503,718 B2
(45) Date of Patent: Mar. 17, 2009

(54) COSMETIC CONTAINER

(75) Inventor: Masafumi Hamada, Fujioka (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 206 days.

(21) Appl. No.: 11/660,204

(22) PCT Filed: Aug. 1, 2005

(86) PCT No.: PCT/JP2005/014012

§ 371 (c)(1),
(2), (4) Date: Feb. 15, 2007

(87) PCT Pub. No.: WO2006/018964

PCT Pub. Date: Feb. 23, 2006

(65) Prior Publication Data

US 2008/0273914 A1 Nov. 6, 2008

(30) Foreign Application Priority Data

Aug. 19, 2004 (JP) ..... 2004-239812
May 25, 2005 (JP) ..... 2005-152782

(51) Int. Cl.
*A46B 11/00* (2006.01)
*A46B 17/08* (2006.01)

(52) U.S. Cl. ..... 401/127; 401/122; 401/126

(58) Field of Classification Search ..... 401/121, 401/122, 126–130
See application file for complete search history.

(56) References Cited

U.S. PATENT DOCUMENTS 5,116,154 A * 5/1992 Fulkerson ..... 401/127
7,118,298 B2 * 10/2006 Tsutsumi ..... 401/129

FOREIGN PATENT DOCUMENTS

JP 55-10288 Y2 3/1980
JP 3-31215 Y2 7/1991
JP 8-226 U 2/1996

* cited by examiner

*Primary Examiner*—David J Walczak
(74) *Attorney, Agent, or Firm*—Kubovcik & Kubovcik

(57) ABSTRACT

A cosmetic container having a container body for receiving cosmetics and a cap having a cap body, an outer tube, and an inner tube. A first spring for urging the outer tube rearward is installed between the cap body and the outer tube. A second spring for urging the cap body forward is received in the inner tube. A shaft section with an application section is projectingly formed on the inner tube. An engagement groove is provided in the container body, in the outer peripheral surface near its head. A locking ball reception hole and a locking ball received in the hole are provided on the cap body. A restriction projection for restricting the locking ball from moving outward is provided inside the outer tube. The locking ball projected inward by the restriction projection fits in the engagement groove, and the cap is installed on the container body.

5 Claims, 16 Drawing Sheets

COSMETIC CONTAINER

This application is a 371 of international application PCT/JP2005/014012 filed Aug. 1, 2005, which claims priority based on Japenese patent application Nos. 2004-239812 and 2005-152782 filed Aug. 19, 2004, and May 25, 2005,respectively, each of which is incorporated herein by reference.

TECHNICAL FIELD

The present invention relates to cosmetic containers which receive cosmetics such as mascara and which have a cap with an applicator.

BACKGROUND ART

Conventional cosmetic containers that receive cosmetics such as mascara commonly have a cap with an applicator so that removal of the cap allows the cosmetics to be immediately applied. A conventional art for a cosmetic container having such an applicator is disclosed in, for example, JP 3-31215 Y.

DISCLOSURE OF THE INVENTION

In such a conventional cosmetic container, a container body and a cap are usually connected together either by frictional engagement, by simple fitting engagement, or by screwing. In particular, with a threaded cosmetic container, when the content is liquid and thus needs to be tightly sealed, the cap is likely to be excessively tightened. This makes later opening of the cap difficult.

Thus, the first object of the present invention is to provide a cosmetic container which using a cap which prevents leakage of the content and which can be opened with a single touch and reliably closed, to offer better usability than conventional screw engagement containers.

Further, in addition to the first object, the second object of the present invention is to enable the cap to be not only opened but also closed with a single touch.

Moreover, in addition to the first object, the third object of the present invention is to minimize the amount of force that needs to be exerted by a user for installation and to make the container usable even if its material is not readily elastically deformed.

Further, in addition to the third object, the fourth object of the present invention is to allow the cap to be sufficiently firmly fixed so as to prevent the cap from being opened upon coming into contact with other cosmetics or the like when the container is carried in a cosmetic porch.

(1) First Invention

In view of the first object, the first invention provides a cosmetic container comprising:

a container body receiving cosmetics inside a shape with an open front end and a closed rear end, having a cylindrical shape at least in the vicinity of the open end, and having an annular engagement groove around an outer periphery of the cylindrical shape, a cap being installed in a covered area extending from the open end of the container body to a predetermined distance rearward including the engagement groove, and a gasket installed between the open end of the container body and the cap;

the cap comprising:

a cap body covering the covered area, an outer tube being externally inserted around the cap body so as to be movable forward and rearward relative to the cap body, a first spring being installed between the cap body and the outer tube to urge the outer tube rearward, an inner tube having an outer diameter smaller than the inner diameter of the cap body, having a closed rear end and an open front end, and being received inside the cap body, a second spring being received inside the inner tube to urge the inner tube rearward and the cap body forward, a shaft section being formed so as to project rearward from the closed end of the inner tube and being received in the container body when the cap body is installed around the covered area, and an application section being provided at a tip of the shaft section and being immersed in the cosmetics when the shaft section is received in the container body;

the cap body having:

a plurality of locking ball reception holes as through-holes formed at positions where the locking ball reception holes align with the engagement groove when the cap body is installed around the covered area, and locking balls as spheres received in the respective locking ball reception holes with a diameter larger than the width of the through-holes in an inner side surface of the cap body;

a restriction projection being provided inside the outer tube as a projection structure corresponding to the locking ball reception holes, restricting outward movement of the locking balls while being urged rearward by the first spring, and releasing the restriction of the outward movement of the locking balls when the outer tube is moved forward against an urging force of the first spring;

an outer peripheral projection being provided on an outer periphery of the inner tube in the vicinity of a tip thereof, projecting outward, and sliding on an inner wall of the cap body; and an inner peripheral projection being provided on an inner periphery of the cap body so as to project inward, being located behind the outer peripheral projection when the cap body is installed around the covered area so as to be locked on the outer peripheral projection when the cap body is moved rearward by an urging force of the second spring.

The term "container body" refers to a container that receives cosmetics. The container body is cylindrical at least in the vicinity of its open end but may be entirely cylindrical. The term "forward" in the present invention is defined as a direction from the closed end toward the open end of the container body, and the term "rearward" as a direction from the open end toward the closed end. Moreover, the term "engagement groove" refers to an annular groove formed in the outer periphery of the container body at its open end. The locking balls described below engage with the engagement groove. The "covered area," around which the cap is installed, is an area extending rearward from the open end of the container body to a predetermined distance, and corresponds to the predetermined range including the engagement groove. Furthermore, though the engagement groove is preferably formed integrally with the container body, a separate part with the engagement groove formed therein may be attached to the container body.

The "cap" is externally installed around the covered area to prevent the cosmetics received in the container body from leaking or drying. To meet this purpose, the "gasket" is installed between the open end of the container body and the cap. The gasket may be fixed either to the container body or to the cap.

The cap in accordance with the first invention has three cylinders, namely, the "cap body," the "outer tube" and the "inner tube."

The cap body is a cylindrical member that directly covers the covered area of the container body. Moreover, the outer cylinder is a cylindrical member externally installed around the cap body so as to be movable forward and rearward. The "first spring" is installed between the cap body and the outer tube to urge the outer tube rearward. For example, the first spring may be a coil spring having a diameter almost equal to the outer diameter of the cap body. The coil spring can be externally installed around the cap body, with its opposite ends fixed between a step provided on an outer side surface of the cap body and an inner side surface of the outer tube.

The inner tube is a cylindrical member inserted into the cap body. The front end of the inner tube is open. On the other hand, the rear end of the inner tube is closed. Namely, the front end (open end) of the inner tube is inserted from the rear end (open end) of the cap body. Then, the "second spring" is received inside the inner tube. The second spring urges the rear end (closed end) of the inner tube and the front end (closed end) of the cap body inside the inner tube so as to push them open.

The outward projecting "outer peripheral projection" is provided on the outer periphery of the inner tube in the vicinity of its tip. The outer peripheral projection may be formed either as a plurality of projections or as an annular projection. The outer peripheral projection slides on the inner peripheral surface of the cap body as the inner tube moves forward and rearward. On the other hand, the inward projecting "inner peripheral projection" is provided on the inner peripheral surface of the cap body. When the outer peripheral projection is formed as a projection, the inner peripheral projection preferably comprises an annular protrusion. In contrast, when the outer peripheral projection is formed as an annular protrusion, the inner peripheral projection is preferably formed as a projection or an annular protrusion. The inner peripheral projection is configured to restrict the maximum distance over which the outer peripheral projection can move rearward relative to the cap body. Accordingly, the outer peripheral projection is abutted against and locked on the inner peripheral projection to prevent the inner tube from slipping off from the cap body.

Moreover; the bar-like "shaft section" is formed so as to project rearward from the closed end of the inner tube and has the "application section" formed at its end. The shape of the application section may be varied depending on the nature or purpose of the cosmetics. For example, when manicure liquid is used as the cosmetics, the application section may be shaped like a brush. When mascara is used, the application section may be shaped like a brush filled with radial bristles. When the cap body is installed around the covered area, the shaft section is entirely received in the container body. In this state, the application section is immersed in the cosmetics in the container body.

The "locking ball reception holes" are through-holes formed in the cap body. A plurality of the locking ball reception holes are formed at positions corresponding to the engagement groove so as to be annually aligned, preferably, at equal intervals.

The "locking balls" are spheres with a diameter that allows the balls to engage with the engagement groove. A material for the locking balls is not particularly limited but is preferably metal such as stainless steel in view of durability. The locking ball has a diameter larger than the width of the locking ball reception holes in the inner side surface of the cap body so as not to slip off into the interior of the cap body.

Furthermore, the width of the locking ball reception holes in an outer side surface of the cap body is not particularly limited. For example, when the width of the locking ball reception holes in the outer side surface of the cap body is larger than the diameter of the locking balls, the locking ball reception holes are curved inward like mortars. In this case, the locking balls can be easily inserted from the outside of the cap body. On the other hand, the locking ball reception holes may be shaped to have a centrally bulging cross section by setting the width of the locking ball reception holes in the outer side surface of the cap body smaller than the diameter of the locking balls. In this case, the locking balls are externally inserted by elastic deformation.

The "restriction projection" that is an inward projecting structure corresponding to the locking ball housing holes is provided on the inner side surface of the outer tube. The restriction projection may be shaped like a projection or an annular protrusion. Moreover, a protrusion structure or the like which abuts against the restriction projection is preferably provided behind the engagement groove in the container body to prevent the outer tube from slipping off rearward.

The first invention is configured as described above to perform the following operations.

As described above, the outer tube is urged rearward relative to the cap body by the first spring. In this state, the restriction projection, located at a position corresponding to the locking ball reception holes, prevents the locking balls from moving outward. Then, each of the locking balls, prevented from moving outward, projects partly from the inner side surface of the cap body, with the projecting part engaging with the engagement groove in the container body. This engagement is maintained by the urging force of the first spring. On the other hand, the cap body is urged forward by the second spring, but the engagement between the locking balls and the engagement groove prevents the cap body from moving forward. In this state, even pulling only the cap body forward does not allow the cap to be removed because the restriction projection prevents the locking balls from moving out of the engagement groove. This allows the cap to be reliably installed around the container body. Moreover, in this state, the gasket installed between the cap and the open end of the container body prevents leakage of the cosmetics.

On the other hand, moving the outer tube forward against the urging force of the first spring moves the restriction projection forward. This enables the locking balls to move outward. In this state, the resistance to the urging force of the second spring is eliminated, allowing the cap body to move forward relative to the inner tube. Then, the movement of the cap body in turn moves the locking balls forward and out of the engagement groove.

At this time, the urging force of the second spring is preferably stronger than that of the first spring so as to prevent priority from being given to the reengagement between the locking balls and the engagement groove resulting from the recovery of the first spring. Specifically, in view of reliable operations and manipulability, the urging force of the first spring is preferably set at 0.49 N to 9.8 N. The urging force of the second spring is preferably set at 0.98 N to 19.6 N. When the urging forces exceed these ranges, it is difficult for users with weaker hand forces, particularly women, to open and close the cap. On the other hand, when the urging forces are lower than these ranges, the reliability of opening and closing operations and the tight contact during closure are degraded.

In particular, the urging forces of the first and second springs are more preferably set at about 7.85 N and about 14.72 N, respectively.

In this state, pulling the cap forward allows it to be easily removed from the container body. At this time, with the cosmetics attached to the application section, it can be immediately applied to a desired area.

Moreover, to install the cap around the container body again, the cap body is placed around the covered area while inserting the shaft section into the container body. At this time, the urging force of the first spring causes the restriction projection to restrict outward movement of the locking balls. This allows the inward projecting locking balls to reduce the inner diameter of the cap body to preclude its installation. Accordingly, the outer tube needs to be kept pulled slightly forward with the user's hand to prevent the restriction projection from restricting outward movement of the locking balls. This provides a space to which the locking balls can escape upon coming into contact with the covered area. Then, when the rear end of the inner tube comes into contact with the front end of the container body, the user loses hold of the outer tube. The urging force of the second spring then moves the cap body forward, while the urging force of the first spring fits the locking balls urged inward by the urging force of the first spring, into the engagement groove. This allows the cap to be installed around the container body again.

(2) Second Invention

In the first invention, the shape of the locking ball reception holes is not particularly limited but may be circular so as to conform to the shape of the locking balls. However, the second invention is, in addition to the characteristics of the first invention, characterized in that the locking ball reception holes are longitudinal slots with a length larger than the longitudinal length of the restriction projection.

Namely, when the locking ball reception holes are slots, then during cap installation, the contact of the locking balls with the covered area forms a rear space to which the locking balls can escape from the restriction projection. Thus, installation of the cap does not require the outer tube to be kept pulled slightly forward with the user's hand but can be achieved simply by pressing the cap against the container body. This facilitates the installation.

(3) Third Invention

In view of the third object, the third invention is, in addition to the characteristics of the first invention, characterized in that an outer peripheral surface of the container body has an almost fixed diameter from the open end to the engagement groove of the container body, and that the longitudinal length of the locking ball reception holes is almost equal to the diameter of the locking balls, and a distance between an outer peripheral surface of the inner tube and an inner peripheral surface of the outer tube is almost equal to the diameter of the locking balls at the positions of the locking ball reception holes while the outer peripheral projection and the inner peripheral projection are engaged.

Here, since the diameter of the outer peripheral surface is almost fixed from the open end to engagement groove of the container body, no rib-like projection structure or step is present between the open end and the engagement groove. For example, the absence of such a projection structure or step eliminates the need for the force required for the locking balls to climb over the projection structure or step. Moreover, if such a projection structure or step is provided, the locking balls are elastically deformed when climbing over it. Accordingly, the third invention is also suitable for the case where the container body is formed of a material that is not readily elastically deformed. The "almost fixed" diameter does not mean that the diameter is precisely fixed. For example, a variation such as a chamfered or curved open end is allowed.

The distance between the outer peripheral surface of the inner tube and the inner peripheral surface of the outer tube is almost equal to the diameter of the locking balls at the positions of the locking ball reception holes while the outer peripheral projection and inner peripheral projection are engaged. Consequently, before the cap is installed, the locking balls fit between the outer peripheral surface of the inner tube and the inner peripheral surface of the outer tube. Namely, before the cap is installed, the locking balls do not project out of the locking balls reception holes. The locking balls can be projected once the inner tube is pressed forward at the open end of the container body during cap installation.

The term "inner peripheral projection" as used herein includes not only a structure such as a projection or protrusion but also a step or the like provided that the structure or step has a height.

This makes it possible to prevent the action of the locking balls from being affected even though the longitudinal length of the locking ball reception holes is almost equal to the diameter of the locking balls.

(4) Fourth Invention

In view of the fourth object, the fourth invention is, in addition to the characteristics of the third invention, characterized in that, when the outer peripheral projection and the inner peripheral projection are engaged, the locking balls are in contact with the outer peripheral surface of the inner tube, the inner peripheral surface of the outer tube, and a rear edge of the restriction projection.

Namely, before the cap is installed, the locking balls are urged by the restriction projection. Consequently, the locking balls can be projected inward provided that installation of the cap pushes the inner tube forward at the open end of the container body to create an inner space.

At this time, when an outer tube stop, a projection structure on which the rear end of the restriction projection is locked is formed outside and behind the locking ball reception holes in the cap body and when the restriction projection restricts outward movement of the locking balls after the cap has been installed around the container body, the rear end of the restriction projection is preferably locked on the outer tube stop. Namely, after the cap is installed, the locking ball reception holes are almost covered by the restriction projection, allowing the cap to be sufficiently firmly fixed.

The present invention is configured as described above to perform the following operations.

Namely, as described above, the first invention provides a cosmetic container which uses a cap which prevents leakage of the content and which can be opened with a single touch and reliably closed, to offer better usability than conventional screw engagement containers.

Moreover, as described above, in addition to exerting the above effect, the second invention enables the cap to be not only opened but also closed with a single touch.

Further, as described above, in addition to exerting the effect of the first invention, the third invention is to minimize the amount of force that needs to be exerted by a user for installation and to make the container usable even if its material is not readily elastically deformed.

Moreover, as described above, in addition to exerting the effect of the third invention, the fourth invention allows the cap to be sufficiently firmly fixed so as to prevent the cap from being opened upon coming into contact with other cosmetics or the like when the container is carried in a cosmetic porch.

BEST MODE FOR CARRYING OUT THE INVENTION

Embodiments of the present invention will be described below with reference to the drawings. Furthermore, the expressions "upper" and "lower" in the description below correspond to the expressions "front" and "rear" in the above description.

(1) First Embodiment

Figure 1:
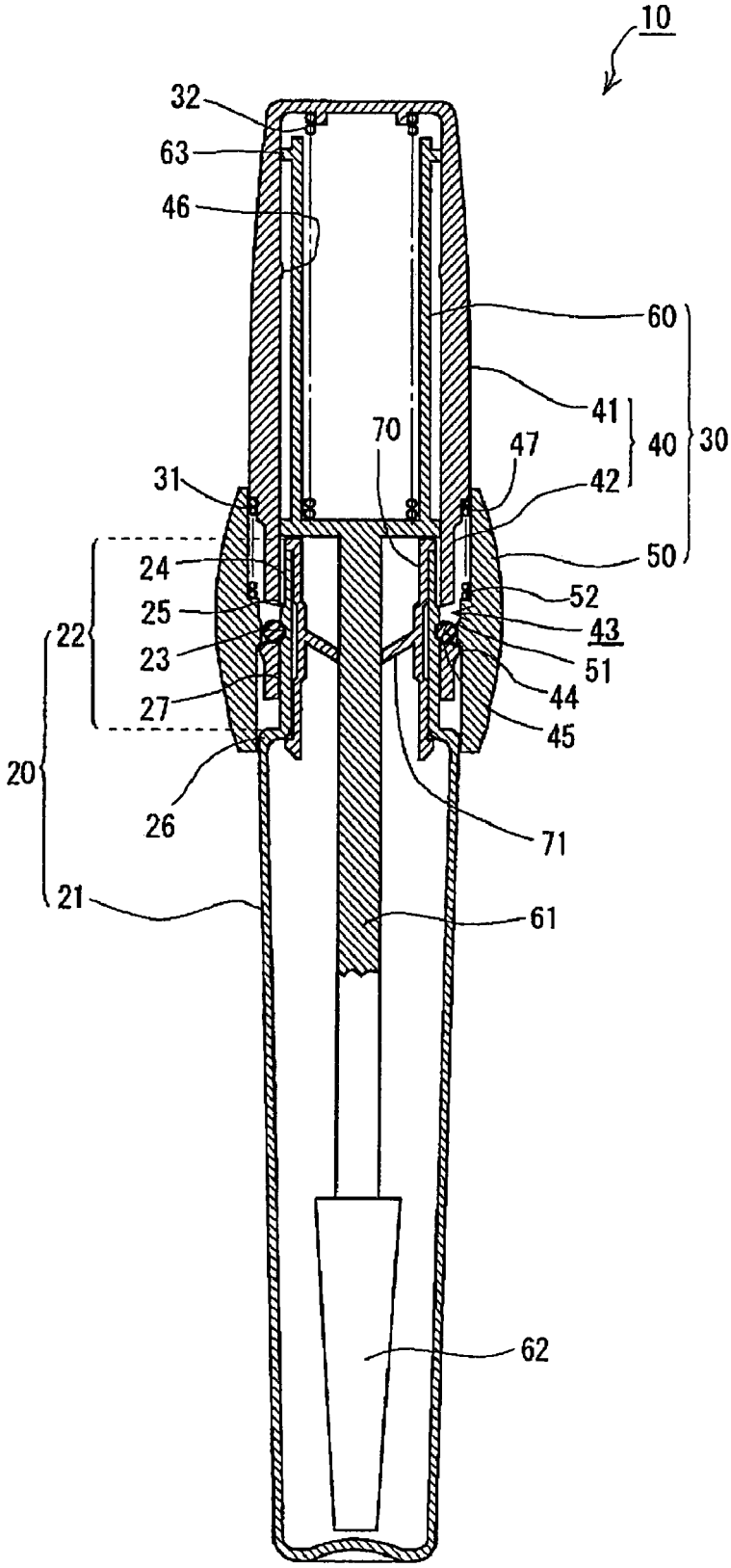
[FIG. 1] A front sectional view showing a cosmetic container in accordance with the first embodiment of the present invention in which a cap has been installed around a container.

A cosmetic-container 10 in accordance with the first embodiment of the present invention, as shown in the sectional view in FIG. 1, has a cap 30 installed around a container body 20. Description will be given below in accordance with the vertical positional relationship in the drawing.

(1-1) Container Body 20

The container body 20 is formed substantially like a cylinder having an open upper end and a closed lower end. The container body 20 has a reduced diameter in its part near its upper end and contiguous to a shoulder 26. The reduced diameter section corresponds to a covered area 22 around which the cap 30 is directly installed. A reception section 21 is located below the covered area 22 and has a larger outer diameter than the covered area 22. The reception section 21 receives cosmetics such as mascara. The covered area 22 has a further reduced diameter in its part contiguous to a step 25, forming a reduced diameter section 24. An engagement groove 23 is formed in an intermediate section 27 between the reduced diameter section 24 and the shoulder 26. The engagement groove 23 is an annular trapezoidal groove extending along the outer periphery of the intermediate section 27 and has an outward extending cross section. The container body 20 can be formed of glass, plastics, or metal.

(1-2) Gasket 70

A hollow, substantially cylindrical gasket 70 made of rubber is pressed in the opening of the container body 20 against the inner periphery thereof. An upper end of the gasket 70 covers an upper edge of the container body 20. Moreover, a squeeze valve 71 that is a downward facing valve structure is formed on an intermediate section of inner periphery of the gasket 70.

(1-3) Cap 30

The cap 30 is roughly divided into a cap body 40, an outer tube 50, and an inner tube 60.

(1-3-1) Cap Body 40

The cap body 40 is formed of plastics and shaped to have a closed upper end and an open lower end. The cap body 40 has a slightly thinner covered section 42 formed at its lower end. A section located above the covered section 42 and having a larger diameter than the covered section 42 is called a grip section 41. The covered section 42 has an inner diameter that allows the covered section 42 to be externally inserted around the outer diameter of intermediate section 27 of the covered area 22. Four locking ball reception holes 43 that are slots formed to extend in a longitudinal direction are arranged in the intermediate section of the covered section 42 at equal intervals in a circumferential direction. Locking balls 45 made of stainless steel are received in the respective locking ball reception holes 43. The locking ball reception holes 43 have, on its outer peripheral side, a width slightly larger than the diameter of the locking balls 45, and on its inner periphery side, a width slightly smaller than the diameter of the locking balls 45. This enables the locking balls 45 to be externally inserted into the respective locking ball reception holes 43. Moreover, each of the locking balls 45 can be partly projected inward without partly slipping off inward. Further, a rear edge of the locking ball reception hole 43 projects slightly to form an outer tube stop 44.

Furthermore, the numbers of the locking ball reception holes 43 and the locking balls 45 are not particularly limited provided that they are arranged at equal intervals in the circumferential direction. However, when the number is not set at four, it is preferably three instead of five or more.

On the other hand, an inner peripheral projection 46 that is an inward extending annual projection is formed in a part of intermediate section of the inner periphery of the grip section 41 that is slightly closer to the upper end of the grip portion 41.

An upper spring receiver 47 that is an annular step is formed in a transition section between the grip section 41 and covered area 42 of the cap body 40.

(1-3-2) Outer Tube 50

The outer tube 50 has a cylindrical structure and is externally inserted around the outer periphery of the covered section 42 of the cap body 40.

An inward projecting restriction projection 51 is formed on a part of intermediate section of the inner periphery of the outer tube 50 which part is slightly closer to the lower end of the outer tube 50. A lower spring receiver 52 that is an annular step is formed above the restriction projection 51. A first spring 31 is installed between the lower spring receiver 52 and the upper spring receiver 47. The first spring 31 urges the cap body 40 upward and the outer tube 50 downward. On the other hand, a lower end surface of the restriction projection 51 is abutted against the outer tube stop 44 of the cap body 40. Namely, the urging force of the first spring 31 always urges the outer tube 50 downward, but the outer tube stop 44 restricts further downward movement of the outer tube 50. At this time, the restriction projection 51 is located in the vicinity of lower half of each of the locking ball reception holes 43. This prevents the locking balls 45 from moving outward. Then, the prevention of outward movement allows the inward projecting locking balls 45 to fit into the engagement groove 23.

(1-3-3) Inner Tube 60

The inner tube 60 is formed substantially like a cylinder having an open upper end and a closed lower end. The inner tube 60 is inserted into the grip section 41 of the cap body 40. Inside the inner tube 60, a second spring 32 is installed between a bottom surface and an undersurface of upper end of the grip section 41. The urging force of the second spring 32 urges the cap body 40 upward and the inner tube 60 downward. On the other hand, an outer peripheral projection 63 that is an outward protrusion is provided around the outer periphery of upper end of the inner tube 60. The outer peripheral projection 63 is movable in a vertical direction while sliding on the inner periphery of the grip section 41. The outer peripheral projection 63 abuts against the inner peripheral projection 46 on the inner periphery of the grip section 41. This restricts further downward movement of the outer peripheral projection 63. Furthermore, the urging force of the second spring 32 is stronger than that of the first spring 31.

Figure 5:
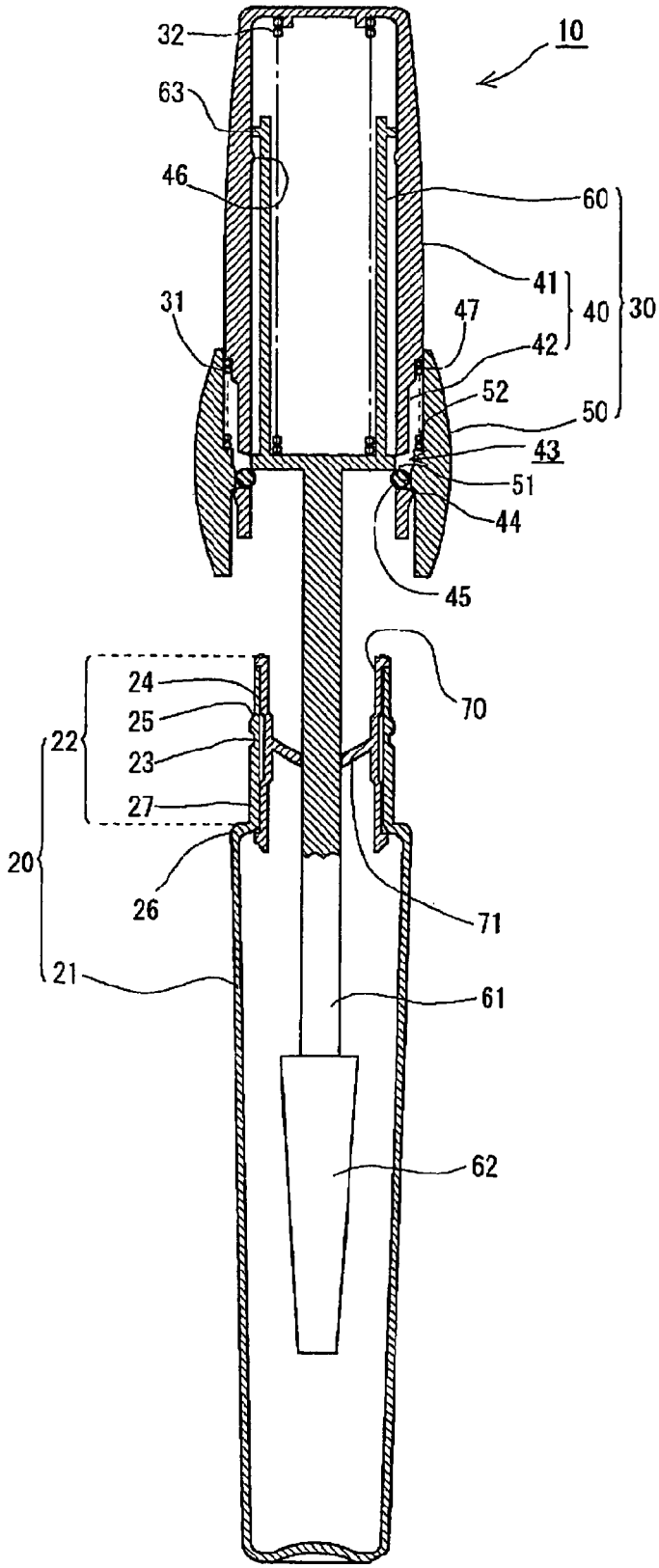
[FIG. 5] A front sectional view showing the cosmetic container in accordance with the first embodiment of the present invention in which the cap has not been installed around the container.

When the cap 30 is opened from the container body 20, the urging force of the second spring 32 causes the edge of bottom surface of the inner tube 60, corresponding to its closed end, to abut against and press the locking balls 45 (see FIG. 5). At this time, each of the locking balls 45 is held so as to abut against the edge of bottom surface of the inner tube 60, the lower end of the corresponding locking ball reception hole 43 in the cap body 40 and the restriction projection 51 of the outer tube 50. Thus, the edge of the bottom surface of the inner tube 60 functions to prevent the inner tube 60 from slipping out of the cap body 40 when the cap 30 is opened.

Moreover, a downward projecting shaft section 61 is integrally formed on the undersurface of bottom surface of the inner tube 60.

Further, a brush-like application section 62 is formed at a head of the shaft section 61. After the cap 30 is installed in the container body 20, namely, in the state shown in FIG. 1, the shaft section 61 and the application section 62 are entirely received in the container body 20. Then, in this state, the application section 62 is immersed in the cosmetics in the reception section 21.

The second spring 32 always exerts an upward urging force on the cap body 40. However, the engagement between the locking balls 45 and the engagement groove 23 inhibits upward movement of the cap body 40. At the same time, the second spring 32 urges the inner tube 60 downward to bring the inner tube 60 into tight contact with the gasket 70.

Moreover, the first spring 31 urges the outer tube 50 downward, but the restriction projection 51 of the outer tube 50 abuts against the outer tube stop 44 of the cap body 40 to prevent the outer tube 50 from moving further downward. At this time, the restriction projection 51 aligns precisely with the engagement groove 23. At the same time, the locking balls 45 lie at the lower ends of the respective locking ball reception holes 43 and also align with the engagement groove 23. This positional relationship allows the restriction projection 51 to project the locking balls 45 inward. Then, the inward projecting locking balls 45 fit into the engagement groove 23 to fix the cap 30 to the container body 20.

Although not clearly seen in FIG. 1, the distance between a lower end of the cap body 40 (a lower end of the covered section 42) and the shoulder 26 of the container body 20 is adjusted to be longer than the vertical length of the locking ball reception hole 43 after the cap 30 has been installed around the container body 20.

(1-4) Removal of the Cap 30

Now, with reference to the drawings, description will be given of how the cap 30 installed around the container body 20 as shown in FIG. 1 is removed.

Figure 2:
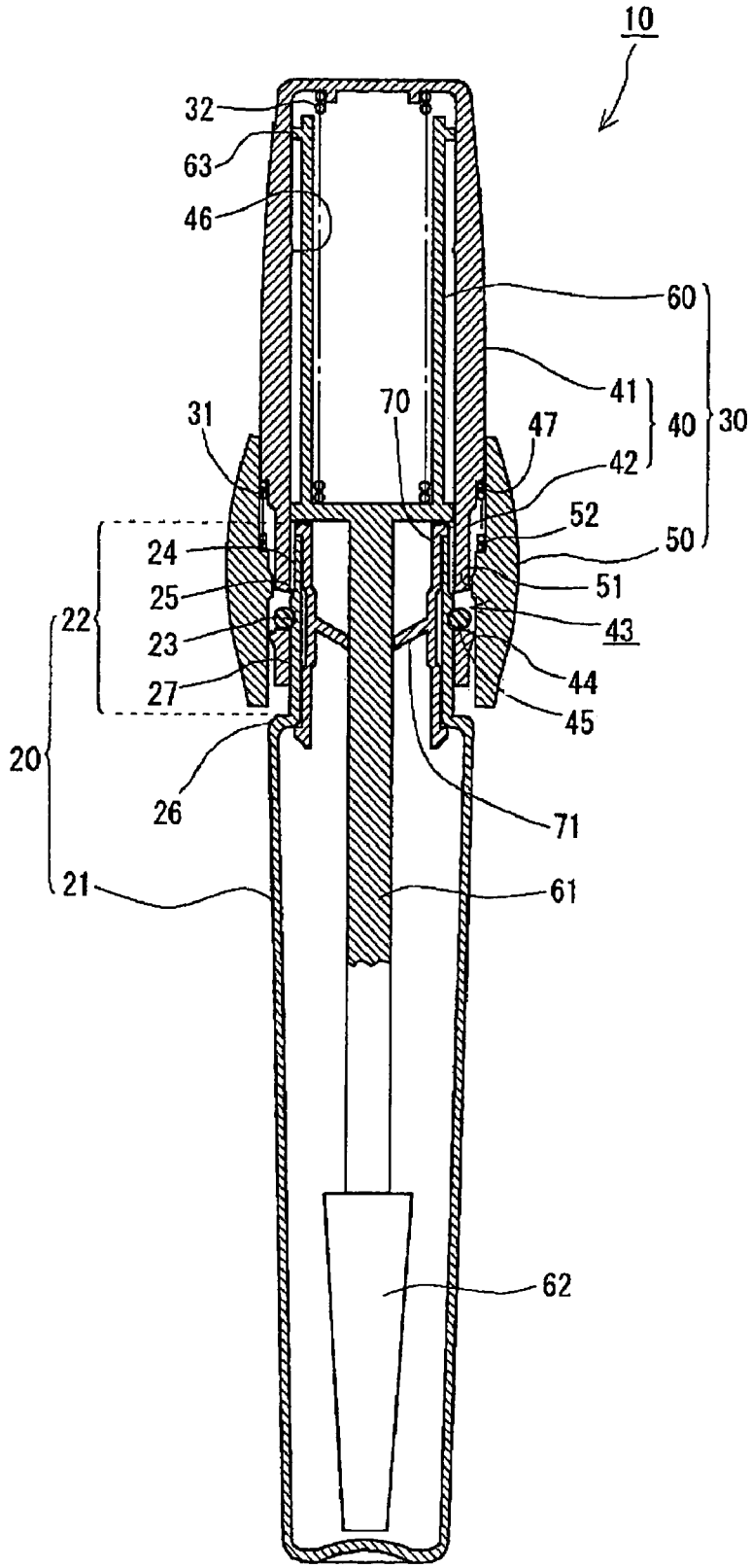
[FIG. 2] A front sectional view showing the cosmetic container in accordance with the first embodiment of the present invention in which the cap is being removed from the container.

First, as shown in FIG. 2, the outer tube 50 is moved upward against the urging force of the first spring 31. At this time, the restriction projection 51 projecting the locking balls 45 inward is also moved. This enables the locking balls 45 to move outward.

Figure 3:
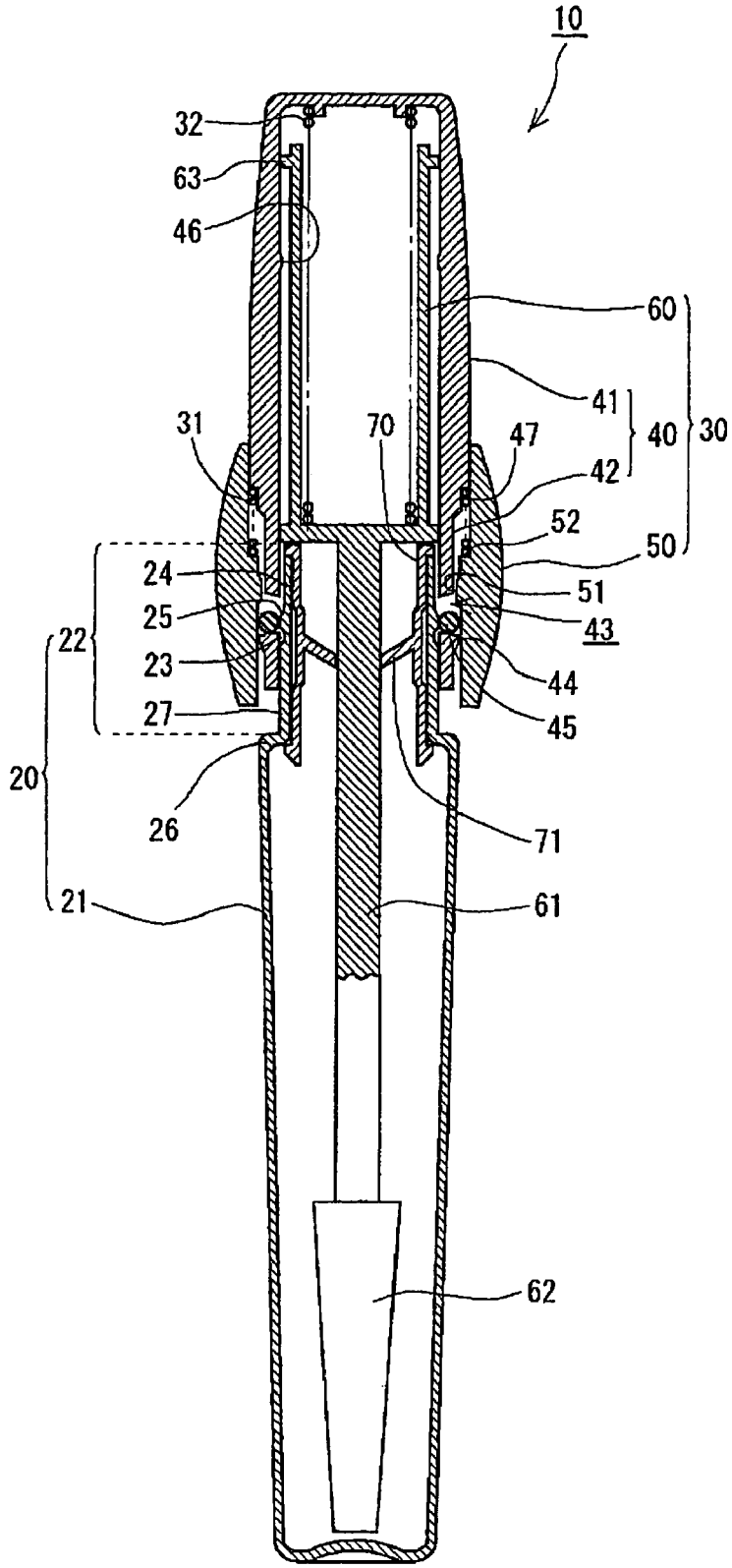
[FIG. 3] A front sectional view showing the cosmetic container in accordance with the first embodiment of the present invention in which the cap is being removed from the container.

In this state, as shown in FIG. 3, the urging force of the second spring 32 moves the cap body 40 upward relative to the inner tube 60. At this time, nothing prevents outward movement of the locking balls 45, which thus leaves the engagement groove 23 and moves upward together with the cap body 40. Here, the urging force of the second spring 32 and the urging force of the first spring 31 oppose each other. However, since the former is stronger as described above, the cap body 40 can be moved upward together with the outer tube 50 while contracting the first spring 31.

Figure 4:
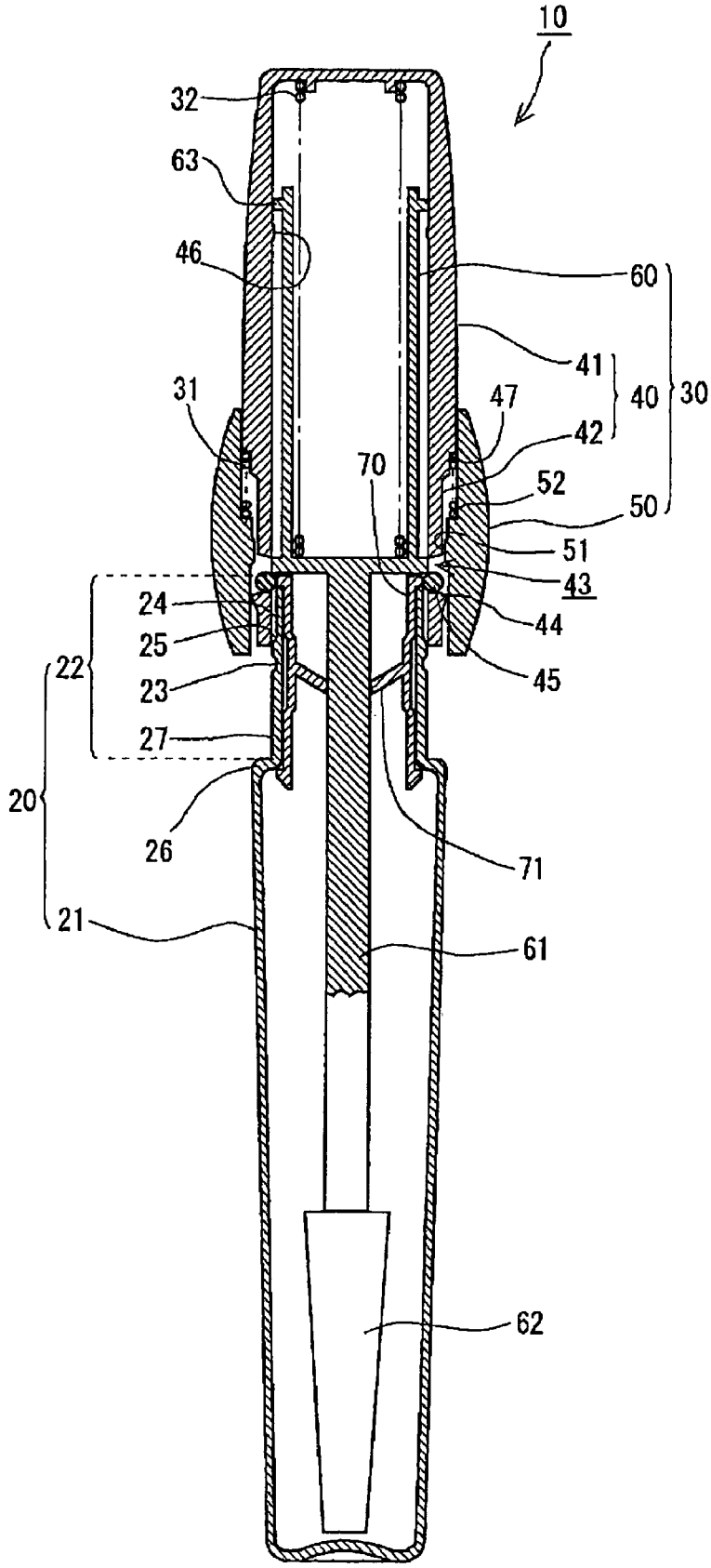
[FIG. 4] A front sectional view showing the cosmetic container in accordance with the first embodiment of the present invention in which the cap is being removed from the container.

Then, as shown in FIG. 4, the cap body 40 moves further upward, but the inner peripheral projection 46 and the outer peripheral projection 63 abut against each other to inhibit the cap body 40 from moving further upward. In this state, the cap 30 itself keeps in contact with the container body 20 but has been disengaged from it. Consequently, simply gripping and raising the grip section 41 upward enables the cap 30 to be easily removed as shown in FIG. 5. At this time, the shaft section 61 moves upward while being squeezed by the squeeze valve 71 of the gasket 70. Finally, after the application section 62 is also squeezed by the squeeze valve 71, the entire cap 30 is exposed from the container body 20. At this time, an extra amount of cosmetics attached to the application section 62 is wiped off by the squeeze valve 71, leaving an appropriate amount of cosmetics. This enables the cosmetics to be applied to a desired area.

(1-5) Installation of the Cap 30

Now, referring to the drawings again, description will be given of how the cap 30 is installed in the container body 20 again.

To install the cap 30 in the container body 20 again, first, the shaft section 61, specifically its application section 62, is inserted into the opening of the container body 20 and the entire cap 30 is moved downward as shown in FIG. 5. Here, the locking balls 45 are pressed against the shoulder of bottom surface of the inner tube 60 urged by the second spring 32 and are thus located at the lower ends of the respective locking ball reception holes 43. However, the restriction projection 51 is also located at the lower ends of the locking ball reception holes 43. This causes each of the locking balls 45 to partly project inward.

Figure 6:
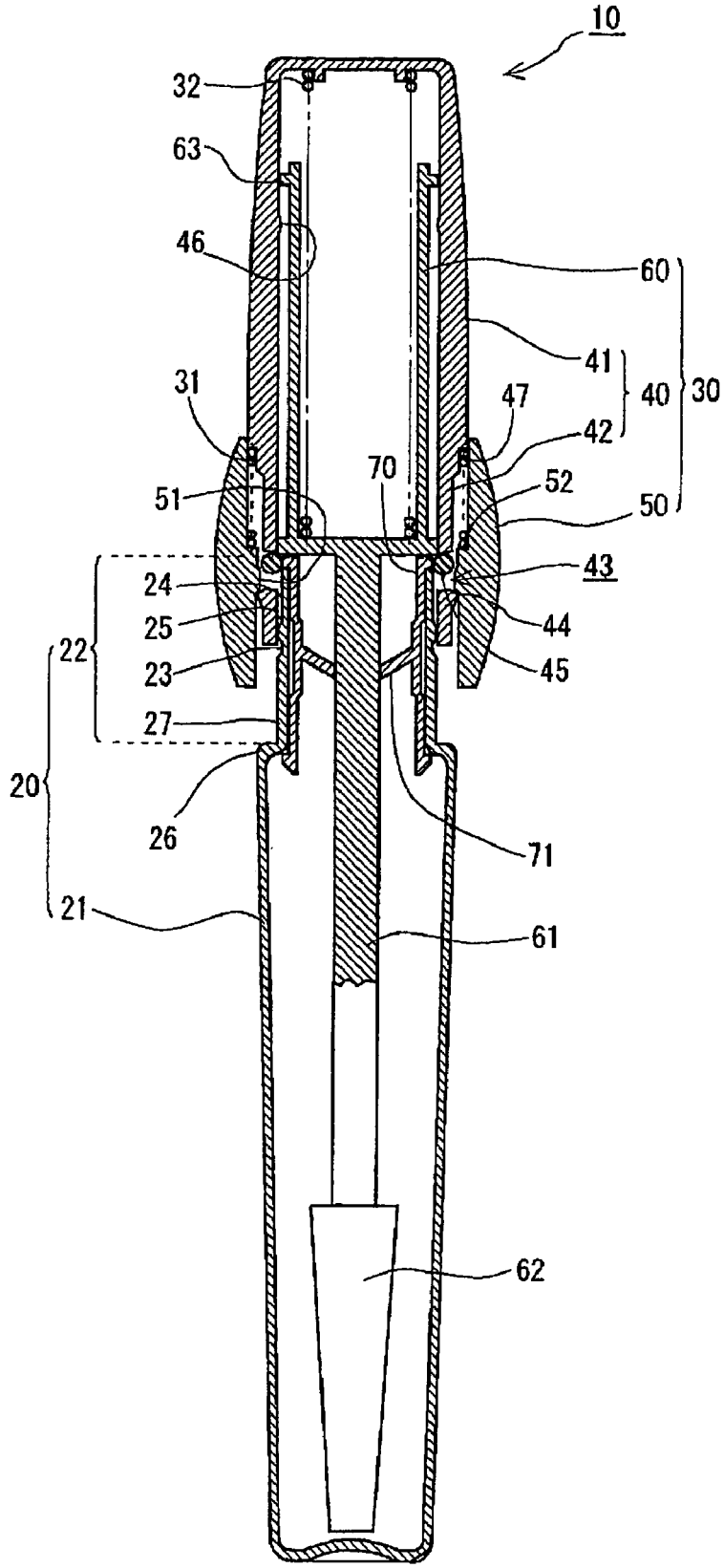
[FIG. 6] A front sectional view showing the cosmetic container in accordance with the first embodiment of the present invention in which the cap is being installed around the container.

Then, when the undersurface of the inner tube 60 comes into contact with the opening of the container body 20, the locking balls 45 partly projecting inward are pushed outward by an upper edge of the gasket 70 as shown in FIG. 6. Then, the locking balls 45 positioned at upper ends of the respective locking ball reception holes 43 in such a way as to be raised by the restriction projection 51.

Figure 7:
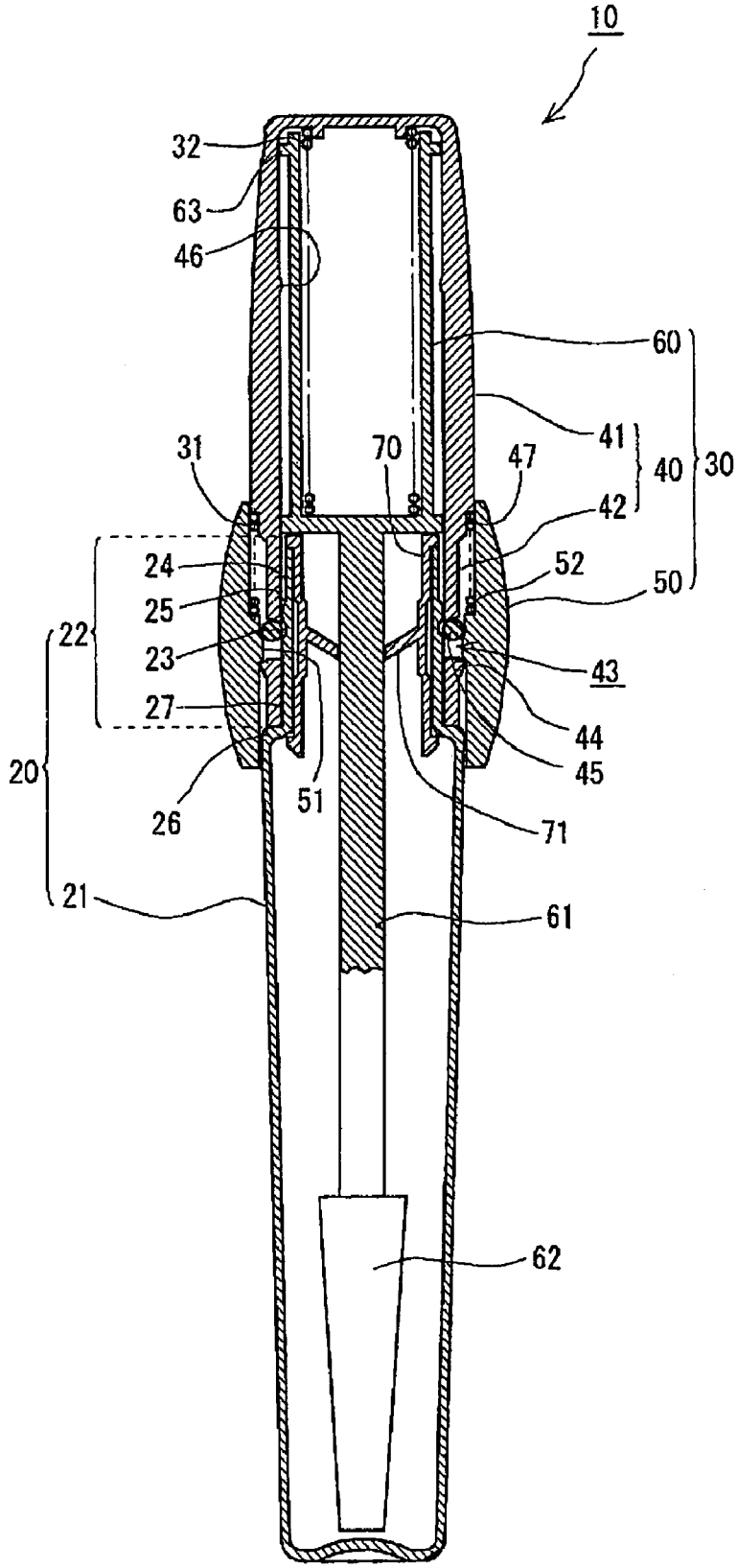
[FIG. 7] A front sectional view showing the cosmetic container in accordance with the first embodiment of the present invention in which the cap is being installed around the container.

In this state, pressing the cap body 40 downward against the urging force of the second spring 32 moves the locking balls 45 downward while keeping them in contact with a reduced diameter section 24 of the covered area 22. Then, the cap body 40 is pressed until a lower end of the covered area 42 comes into contact with the shoulder 26 of the container body 20. Then, as shown in FIG. 7, the locking balls 45 climb over the step 25 in the covered area 22 while remaining at the upper ends of the respective locking ball reception holes 43. Further, the locking balls 45 passes over the engagement groove 23 and moves slightly further.

In this state, releasing the pressure on the cap body 40 moves the cap body 40 back upward under the urging force of the second spring 32. At this time, the locking balls 45 are pushed up by the lower ends of the respective locking ball reception holes 43. While pushed up, the locking balls 45 are projected inward by the restriction projection 51. Then, upon reaching the engagement groove 23, the pushed-up locking balls 45 fit into the engagement groove 23 because they are projected inward by the restriction projection 51. Then, the cap body 40 stops returning upward to recover the engaged state shown in FIG. 1.

Here, as described in (1-3) above, the distance (hereinafter referred to as the "distance A") between the lower end of the cap body 40 (the lower end of the covered section 42) and the shoulder 26 of the container body 20 is adjusted to be longer than the vertical distance (hereinafter referred to as the "distance B") of the locking ball reception hole 43 after the cap 30 has been installed around the container body 20. Namely, if the shoulder 26 is formed on the container body 20, when the cap 30 is installed around the container body 20, pressing the lower end of the cap body 40 until it abuts against the shoulder 26 ensures that, while the cap body 40 moves the distance A, the locking balls 45 move the distance B within the respective locking ball reception holes 43 and are projected inward by the restriction projection 51.

Figure 8:
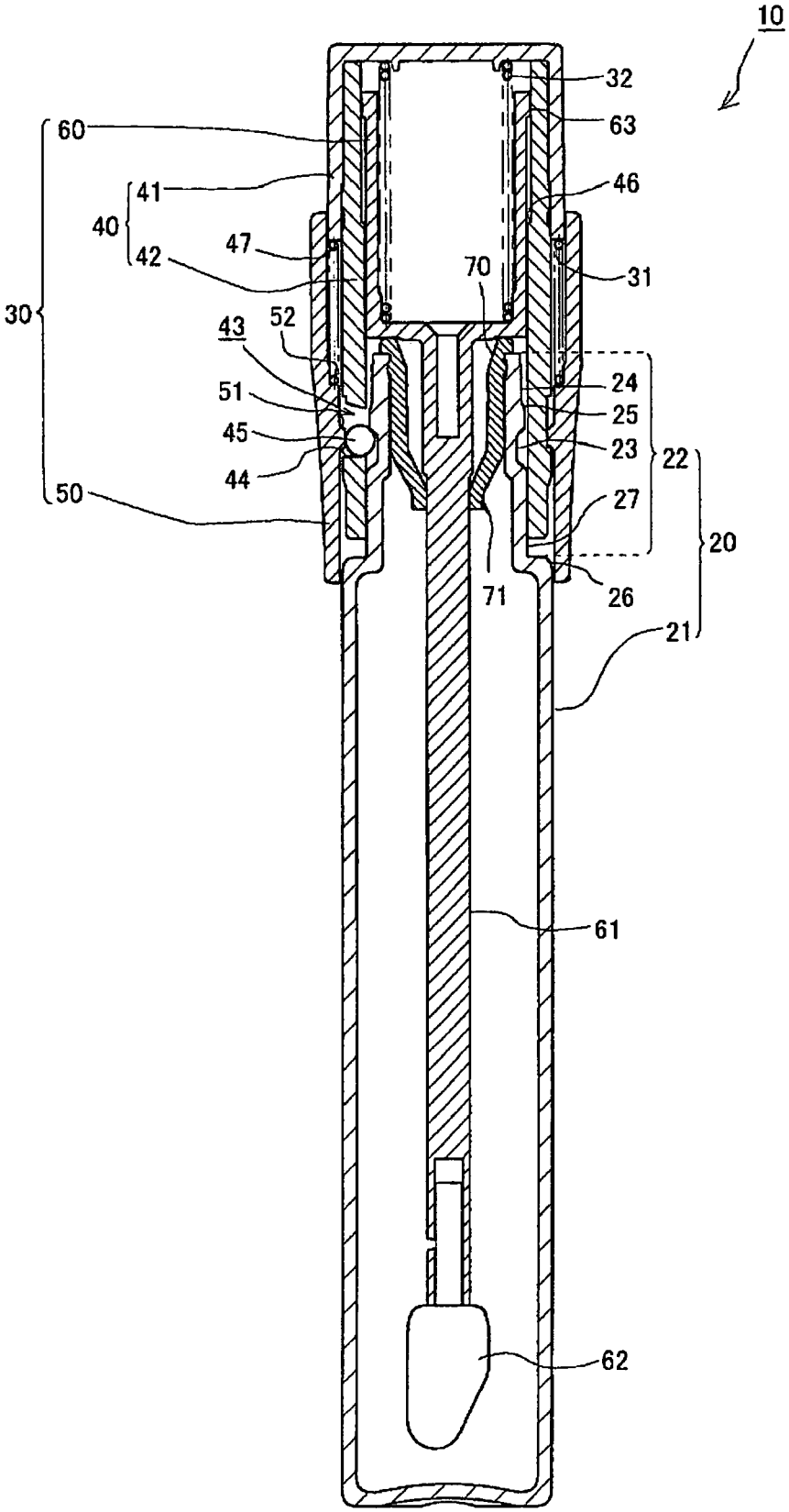
[FIG. 8] A front sectional view of a variation of an application section in the cosmetic container in accordance with the first embodiment of the present invention.

Furthermore, in the present embodiment, the shape of the application section 62 may be appropriately varied depending on the content of the cosmetics received in the container body 20. For example, if lip gloss or the like which is more fluid than mascara is received as cosmetics, the shaft section 61 may have an application section 62 installed at its head and formed by electrostatically implanting nylon bristles of length about 0.5 mm on a surface of a short, cylindrical synthetic resin chip with an obliquely cut end as shown in FIG. 8. Moreover, if eyeliner, manicure, liquid lipstick, or lip gloss is received as cosmetics, a (thin, round, or flat) brush-like application section 62 can be installed.

(2) Second Embodiment

Figure 9:
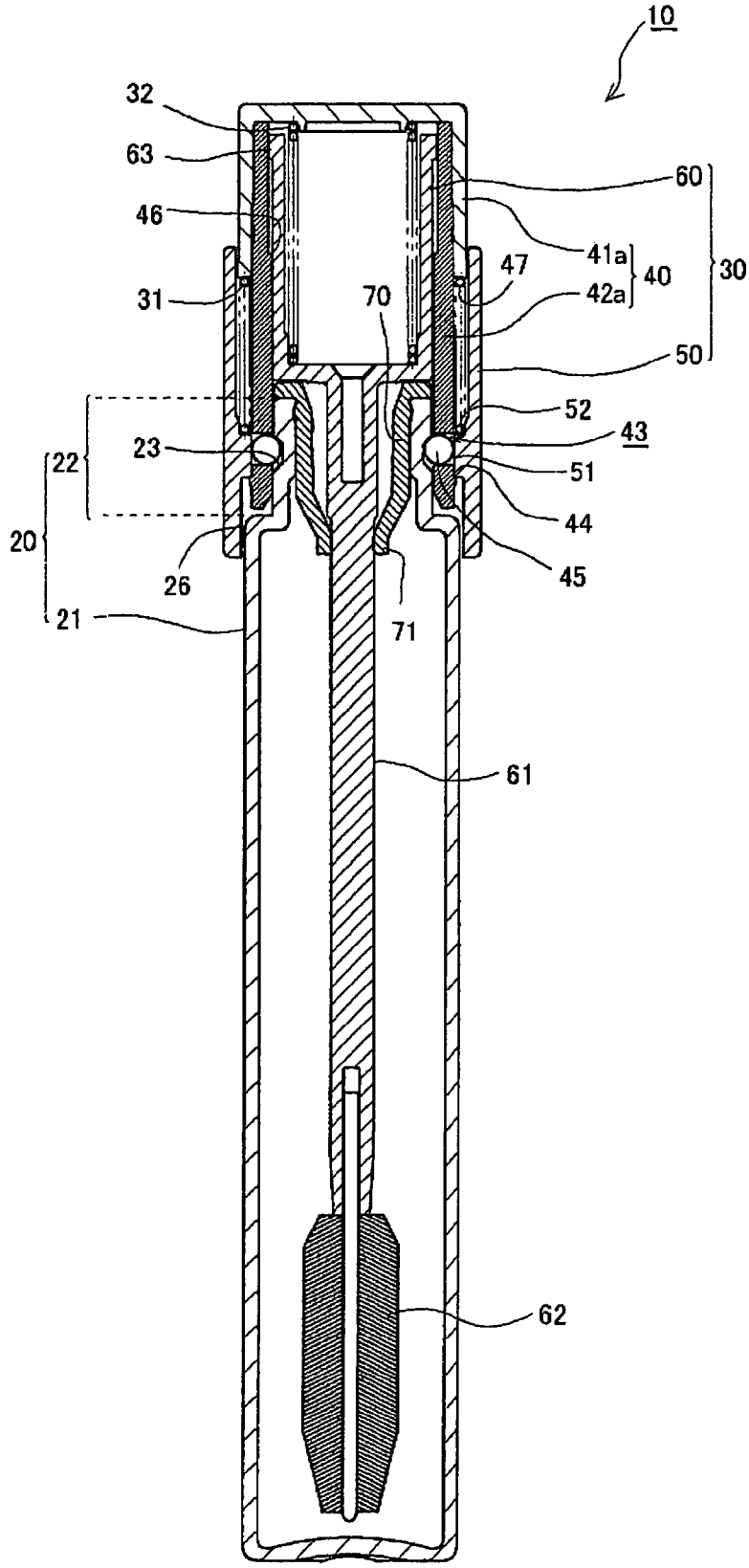
[FIG. 9] A front sectional view showing a cosmetic container in accordance with a second embodiment of the present invention in which a cap has been installed around a container.

The cosmetic container 10 in accordance with the second embodiment of the present invention has the cap 30 installed around the container body 20 as shown in the sectional view in FIG. 9. Description will be given below in accordance with the vertical positional relationship in the drawing.

(2-1) Container Body 20

The container body 20 is formed substantially like a cylinder having an open upper end and a closed lower end. The container body 20 has a reduced diameter in its part near its upper end and contiguous to the shoulder 26. The reduced diameter section corresponds to the covered area 22 around which the cap 30 is directly installed. The reception section 21 is located below the covered area 22 and has a larger outer diameter than the covered area 22. The reception section 21A receives cosmetics such as mascara. The engagement groove 23 is formed in the intermediate section between the open end and the shoulder 26 in the covered area 22. The engagement groove 23 is an annular trapezoidal groove extending along the outer periphery of the intermediate section and has an outward extending cross section. The covered area 22 is formed to have an almost fixed outer diameter except for the engagement groove 23. The container body 20 can be formed of glass, plastics, or metal.

(2-2) Gasket 70

A hollow, substantially cylindrical gasket 70 made of plastics (for example, thermoplastic elastomer) and having a tapered lower end is pressed in the opening of the container body 20 against the inner periphery thereof. The upper end of the gasket 70 covers the upper edge of the container body 20. A protrusion extending toward the outer periphery is provided immediately below the upper end of the gasket 70. The protrusion engages with a groove formed in the inner periphery of opening of the container body 20. This allows the gasket 70 to be secured to the container body 20. Moreover, the lower end of the gasket 70 is formed into a squeeze valve 71 that is a downward facing valve structure.

(2-3) Cap 30

The cap 30 is roughly divided into the cap body 40, the outer tube 50, and the inner tube 60.

(2-3-1) Cap Body 40

The cap body 40 comprises a cylinder 42*a* made of polybutylene terephthalate and having an open upper end and an open lower end and a cylindrical button 41*a* also made of polybutylene terephthalate and having a closed upper end and an open lower end, the button 41*a* being shorter than the cylinder 42*a*. Namely, the cap body 40 is formed by placing the button 41*a* over the upper end of the cylinder 42*a* and securing it to the upper end.

The cylinder 42*a* has an inner diameter that allows the cylinder 42*a* to be externally inserted around the outer diameter of intermediate section 27 of the covered area 22. The four locking ball reception holes 43 are arranged near a lower end of the cylinder 42*a* at equal intervals in the circumferential direction. The locking balls 45 made of stainless steel are received in the respective locking ball reception holes 43. The locking ball reception holes 43 have a vertical length almost the same as the diameter (2.5 mm) of the locking balls 45.

Thus, this prevents the relative movement of the locking balls 45 within the locking ball reception holes 43 during installation or removal of the cap 30. Moreover, each of the locking ball reception holes 43 has, on its outer peripheral side, a width slightly larger than the diameter of the locking balls 45, and on its inner peripheral side, a width slightly smaller than the diameter of the locking balls 45. This enables the locking balls 45 to be externally inserted into the respective locking ball reception holes 43. Moreover, each of the locking balls 45 can be partly projected inward without partly slipping off inward. Further, a small projection is formed at a position slightly below the rear edges of the locking ball reception holes 43. The small projection forms an outer tube stop 44.

Furthermore, the numbers of the locking ball reception holes 43 and the locking balls 45 are not particularly limited provided that they are arranged at equal intervals in the circumferential direction. However, if the number is not set at four, it is preferably three instead of five or more in view of the easiness of molding.

On the other hand, a step-like inner peripheral projection 46 is formed in a part of intermediate section of the inner periphery of the cylinder 42*a* which part is slightly closer to the upper end of the cylinder 42*a*. The part of the cylinder 42*a* below the inner peripheral projection 46 has a slightly smaller inner diameter.

A step is formed between a lower edge of button 41*a* of the cap body 40 and the cylinder 42*a* and serves as an upper spring receiver 47.

(2-3-2) Outer Tube 50

The outer tube 50 is made of polyoxymethylene and has a cylindrical structure. With the cap 30 installed, the outer tube 50 is externally inserted around the outer periphery of a part of the cylinder 42*a* of the cap body 40 which is not covered by the button 41*a*.

The restriction projection 51 that is an inward extending annual projection is formed on a part of intermediate section of the inner periphery of the outer tube 50 which part is slightly closer to the lower end of the outer tube 50. The vertical length of the restriction projection 51 is almost equal to the distance from the upper edges of the locking ball reception holes 43 to the outer cylinder stop 44. The upper edge of the restriction projection 51 is formed into a lower spring receiver 52 that is an annular step. A first spring 31 made of stainless steel is installed between the lower spring receiver 52 and the upper spring receiver 47. The first spring 31 urges the cap body 40 upward and the outer tube 50 downward. On the other hand, the lower end surface of the restriction projection 51 is abutted against the outer tube stop 44 of the cap body 40. Namely, the urging force of the first spring 31 always urges the outer tube 50 downward, but the outer tube stop 44 restricts further downward movement of the outer tube 50. At this time, the restriction projection 51 covers the entire locking ball reception holes 43, preventing the locking balls 45 from moving outward. Then, the prevention of outward movement allows the projecting locking balls 45 partly projecting inward to fit into the engagement groove 23.

(2-3-3) Inner Tube 60

The inner tube 60 is formed substantially like a cylinder having an open upper end and a closed lower end. The inner tube 60 is inserted into the cylinder 42*a* of the cap body 40. Inside the inner tube 60, the second spring 32 is installed between its bottom surface and the undersurface of upper end of the button 41*a*. The urging force of the second spring 32 urges the cap body 40 upward and the inner tube 60 downward. On the other hand, the outer peripheral projection 63 that is an outward protrusion is provided around the outer periphery of upper end of the inner tube 60. The outer peripheral projection 63 is movable in a vertical direction while sliding on the inner periphery of the cylinder 42*a*. The outer peripheral projection 63 abuts against the inner peripheral projection 46 on the inner periphery of the cylinder 42*a*. This restricts further downward movement of the outer peripheral projection 63. The urging force (14.72 N) of the second spring 32 is stronger than that (7.85 N) of the first spring 31.

Moreover, the downward projecting shaft section 61 is integrally formed on the undersurface of bottom surface of the inner tube 60. Further, the brush-like application section 62 filled with radial bristles is formed at the tip of the shaft section 61. After the cap 30 is installed in the container body 20, namely, in the state shown in FIG. 9, the shaft section 61 and the application section 62 are entirely received in the container body 20. Then, in this state, the application section 62 is immersed in the cosmetics in the reception section 21.

The second spring 32 always exerts an upward urging force on the cap body 40. However, the engagement between the locking balls 45 and the engagement groove 23 inhibits upward movement of the cap body 40. At the same time, the second spring 32 urges the inner tube 60 downward to bring its closed end into tight contact with the gasket 70.

Moreover, the first spring 31 urges the outer tube 50 downward, but the restriction projection 51 of the outer tube 50 abuts against the outer tube stop 44 of the cap body 40 to prevent the outer tube 50 from moving further downward. At this time, the restriction projection 51 is located to cover the entire engagement groove 23. This positional relationship allows the restriction projection 51 to project the locking balls 45 inward. Then, the inward projecting locking balls 45 fit into the engagement groove 23 to fix the cap 30 to the container body 20.

(2-4) Removal of the Cap 30

Now, with reference to the drawings, description will be given of how the cap 30 installed around the container body 20 as shown in FIG. 9 is removed.

Figure 10:
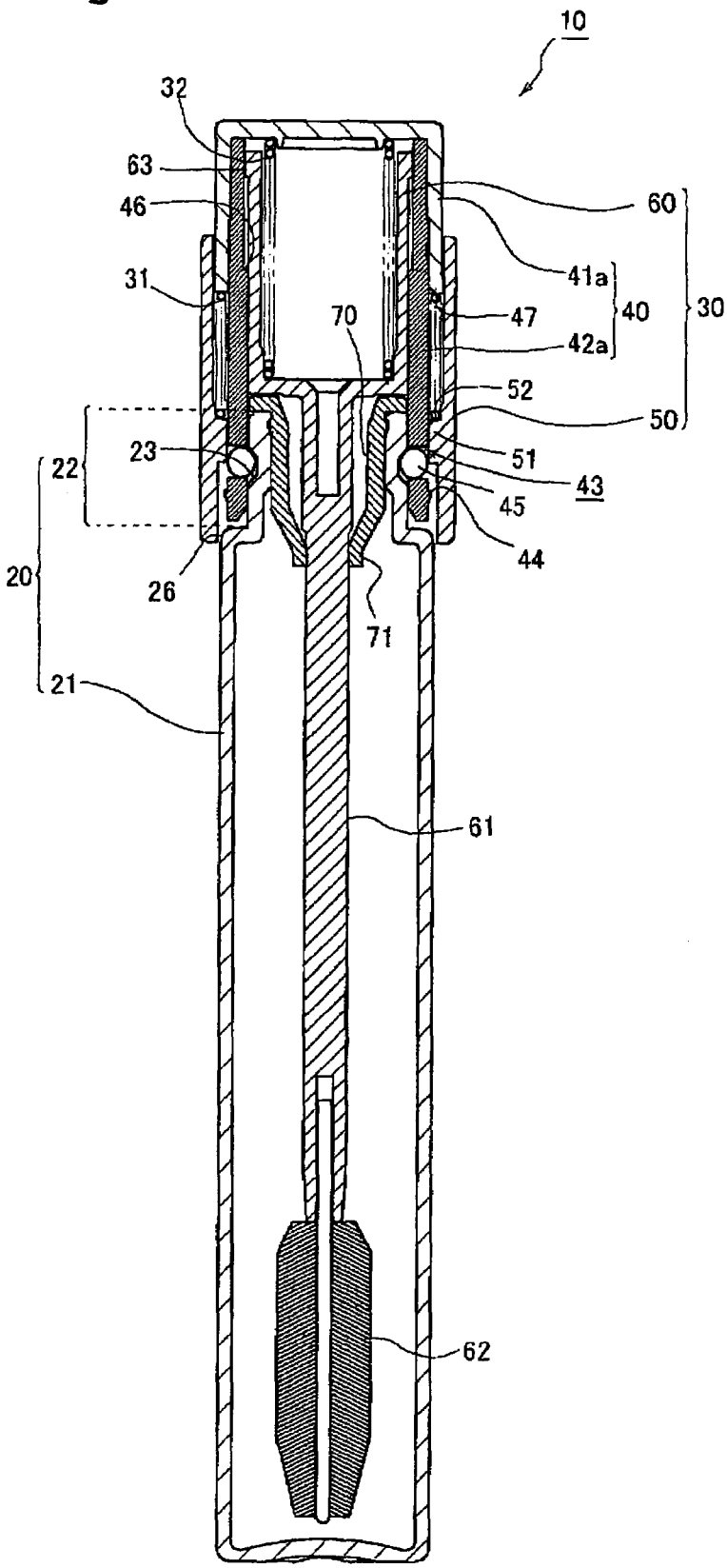
[FIG. 10] A front sectional view showing the cosmetic container in accordance with the second embodiment of the present invention in which the cap is being removed from the container.
Figure 11:
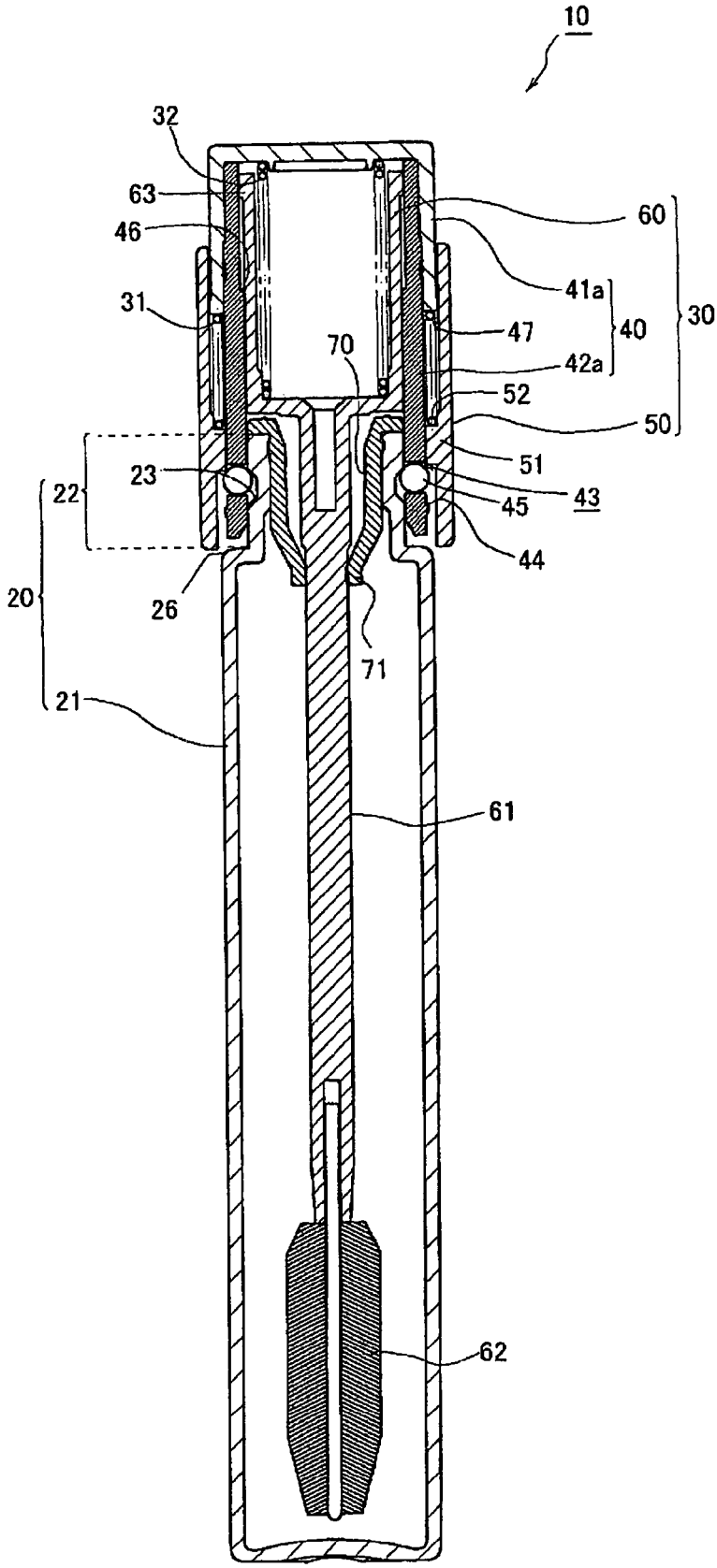
[FIG. 11] A front sectional view showing the cosmetic container in accordance with the second embodiment of the present invention in which the cap is being removed from the container.

First, as shown in FIG. 9, the outer tube 50 is gripped, for example, with the user's thumb and middle finger and such an operation as presses the button 41*a* from above with the user's forefinger is performed. Then, as shown in FIG. 10, the outer tube 50 moves upward relative to the cab body 40 against the urging force of the first spring 31. At this time, the restriction projection 51 projecting the locking balls 45 inward is also moved upward. Here, about 5 mm of relative upward movement of the restriction projection 51 releases the binding force that inhibits outward movement of the locking balls 45. The locking balls 45 are subjected to the downward urging force of the second spring 32 to move outward (see FIG. 11).

Outward movement of the locking balls 45 disengages the cap 30 from the container body 20. Then, the urging force of the second spring 32 moves the cap body 40 upward relative to the inner tube 60. Here, the urging force of the second spring 32 and the urging force of the first spring 31 oppose each other. However, since the former is stronger as described above, the cap body 40 can be moved upward together with the outer tube 50 while contracting the first spring 31.

Figure 12:
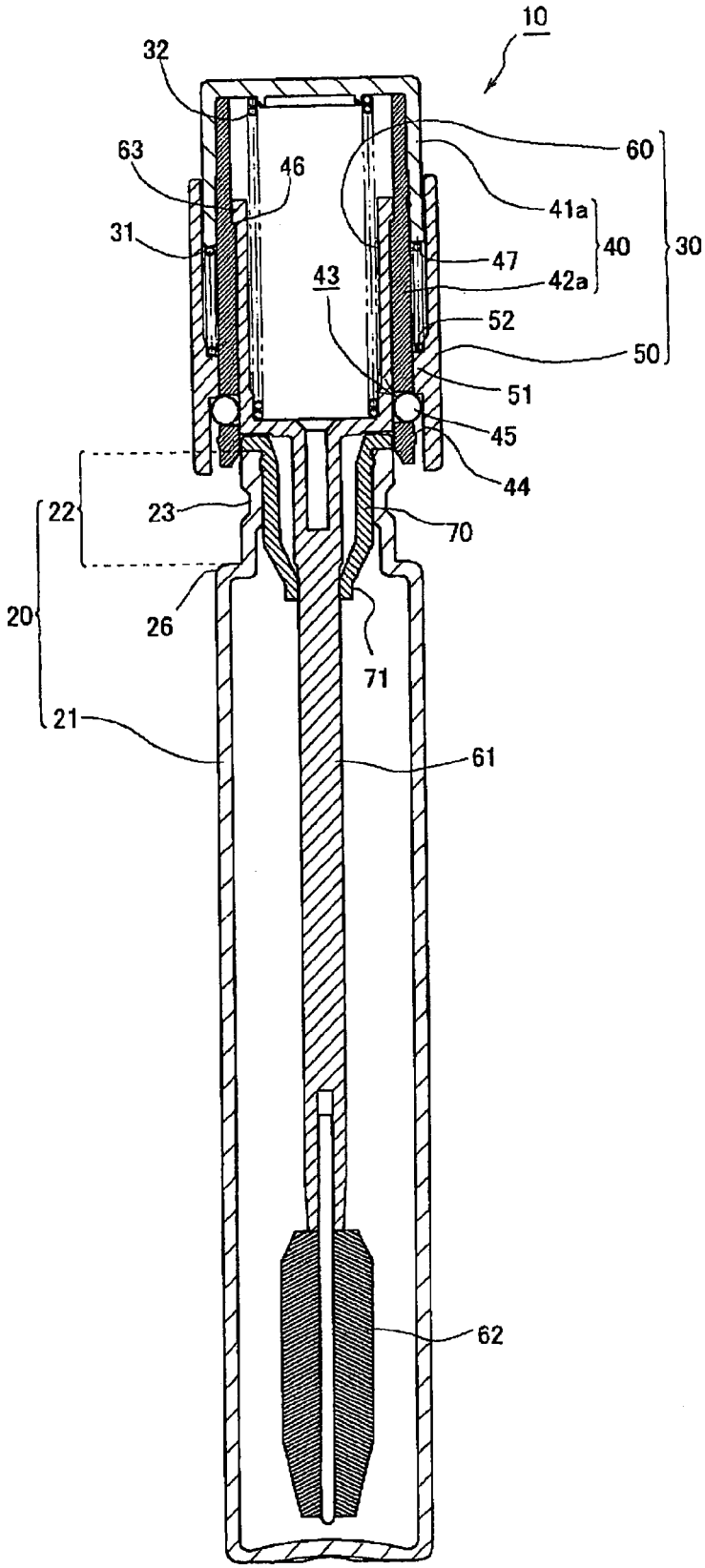
[FIG. 12] A front sectional view showing the cosmetic container in accordance with the second embodiment of the present invention in which the cap is being removed from the container.

Then, as shown in FIG. 12, the cap body 40 moves further upward, but the inner peripheral projection 46 and the outer peripheral projection 63 abut against each other to inhibit the cap body 40 from moving further upward. Here, the locking balls 45 are held in the locking ball reception holes 43 by an outer side surface of the inner tube 60, an outer side surface of the outer tube 50, and the lower edge of the restriction projection 51 of the outer tube 50 urged downward by the first spring.

Figure 13:
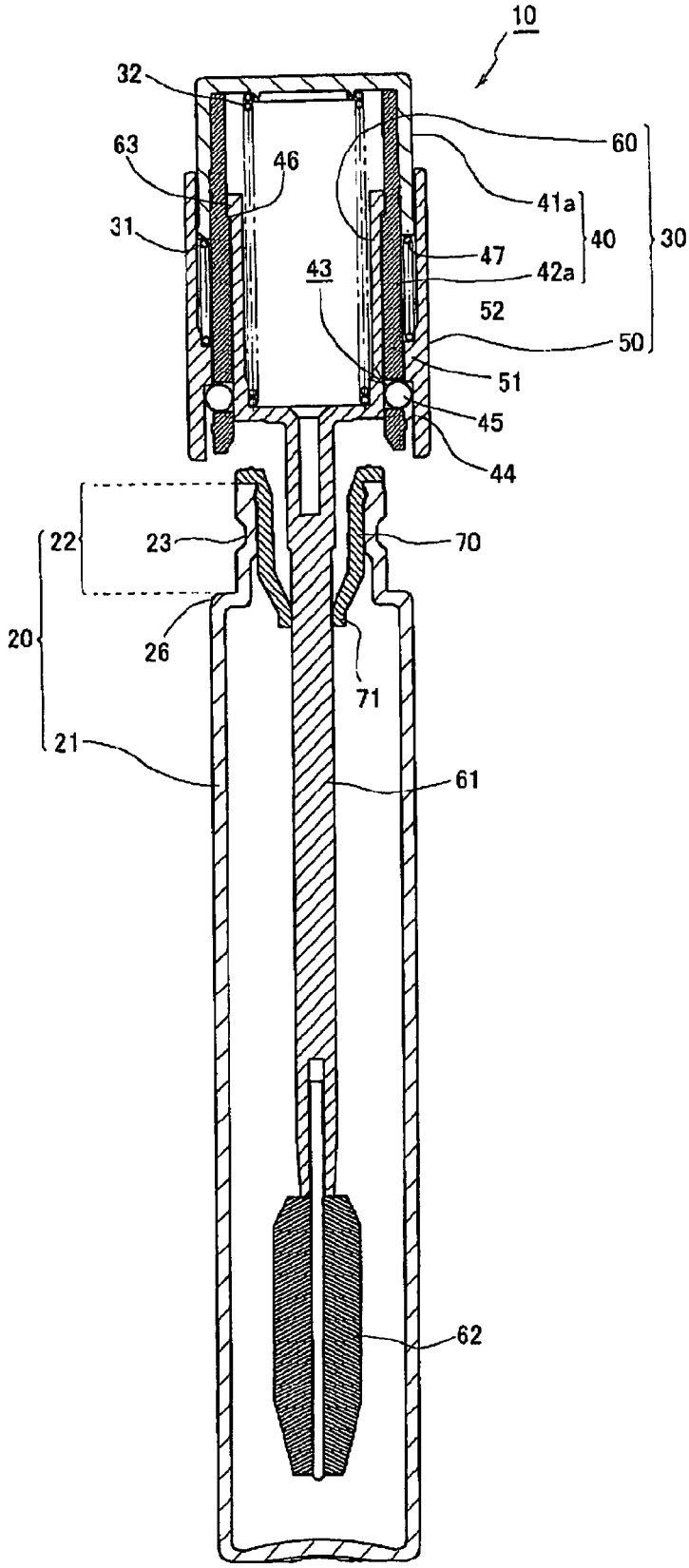
[FIG. 13] A front sectional view showing the cosmetic container in accordance with the second embodiment of the present invention in which the cap has not been installed around the container.

In this state, the cap 30 itself keeps in contact with the container body 20 but has been disengaged from it. Consequently, simply gripping and raising the outer tube 50 upward enables the cap 30 to be easily removed as shown in FIG. 13. At this time, the shaft section 61 moves upward while being squeezed by the squeeze valve 71 of the gasket 70. Finally, after the application section 62 is also squeezed by the squeeze valve 71, the entire cap 30 is exposed from the container body 20. At this time, an extra amount of cosmetics attached to the application section 62 is wiped off by the squeeze valve 71, leaving an appropriate amount of cosmetics. This enables the cosmetics to be applied to a desired area.

(2-5) Installation of the Cap 30

Now, referring to the drawings again, description will be given of how the cap 30 is installed in the container body 20 again.

To install the cap 30 around the container body 20 again, first, the shaft section 61, specifically its application section 62, is inserted into the opening of the container body 20 and the entire cap 30 is moved downward as shown in FIG. 13.

Figure 14:
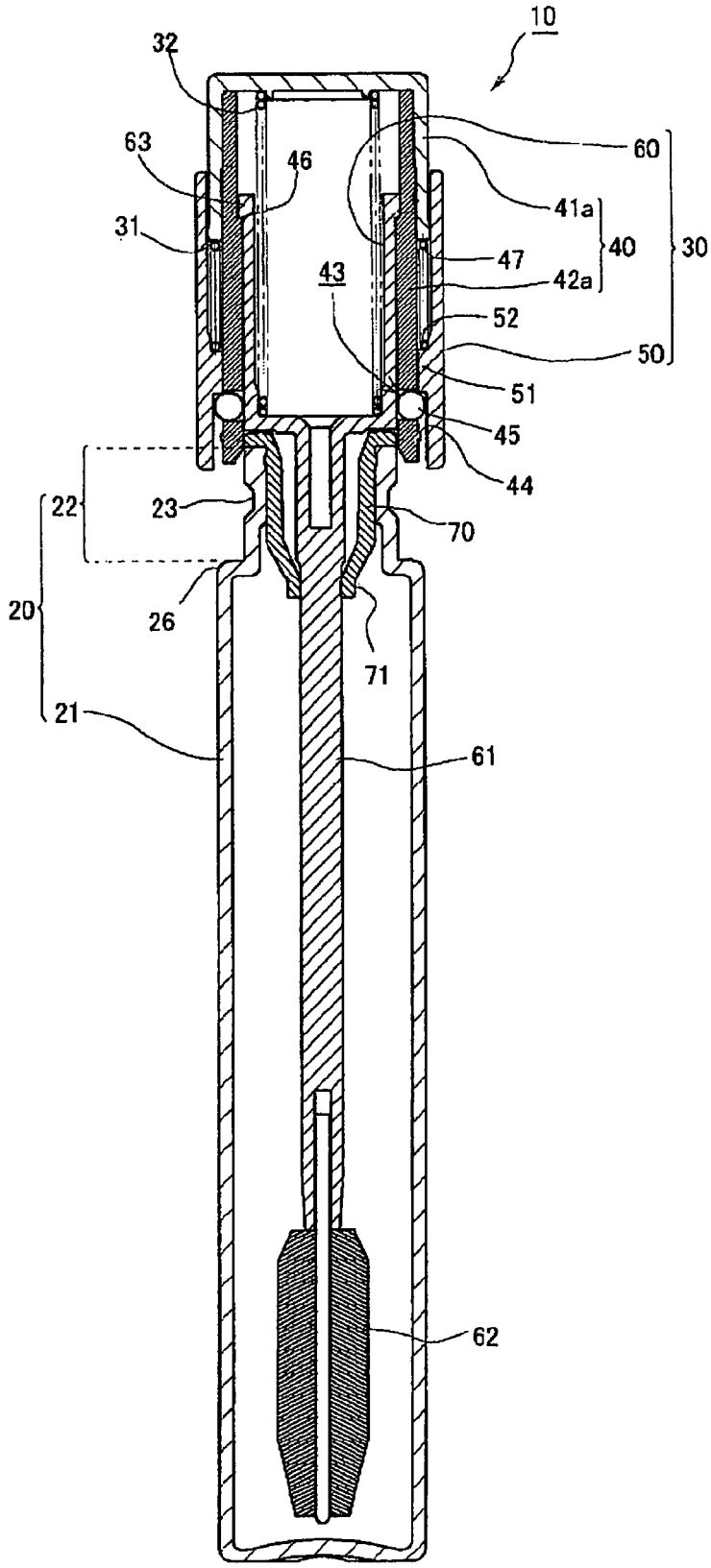
[FIG. 14] A front sectional view showing the cosmetic container in accordance with the second embodiment of the present invention in which the cap is being installed around the container.
Figure 15:
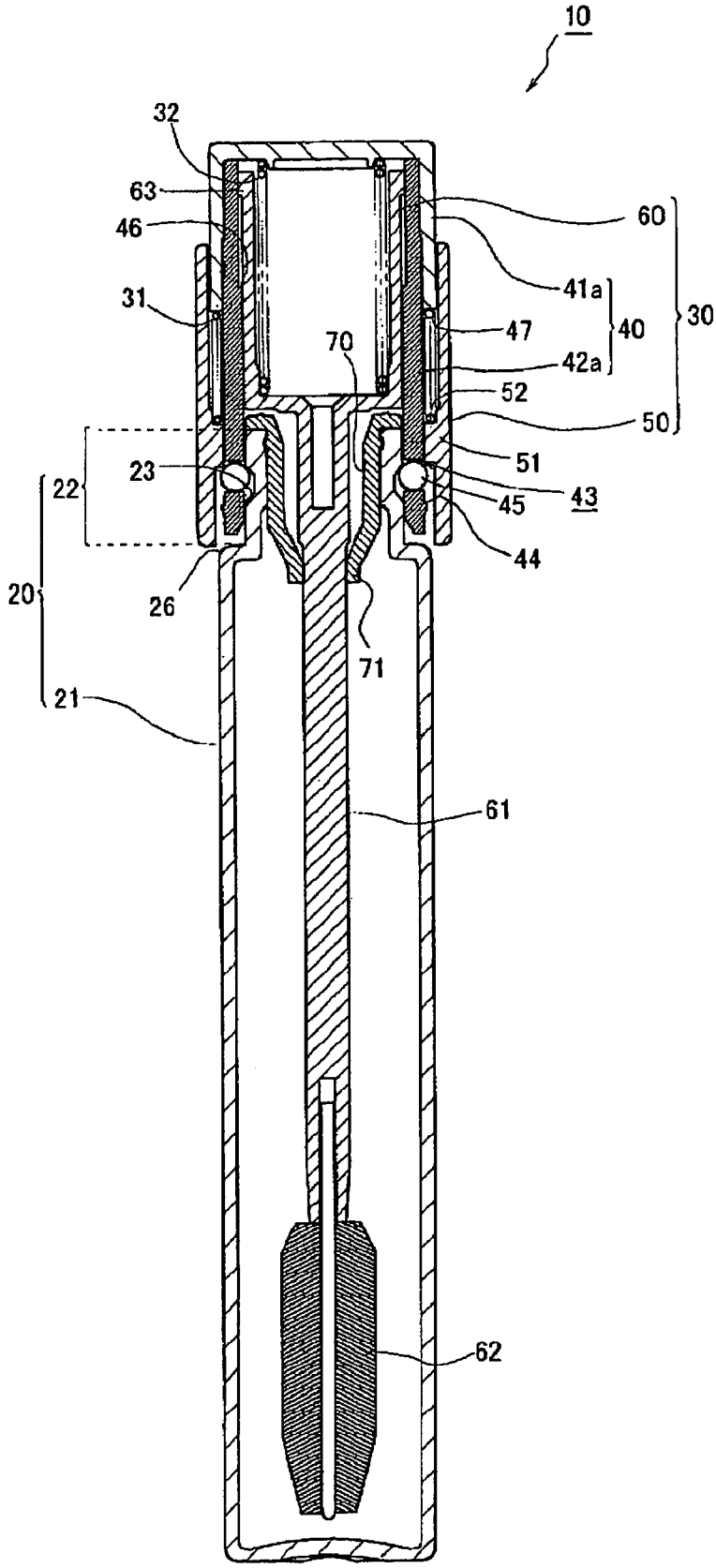
[FIG. 15] A front sectional view showing the cosmetic container in accordance with the second embodiment of the present invention in which the cap is being installed around the container.
Figure 16:
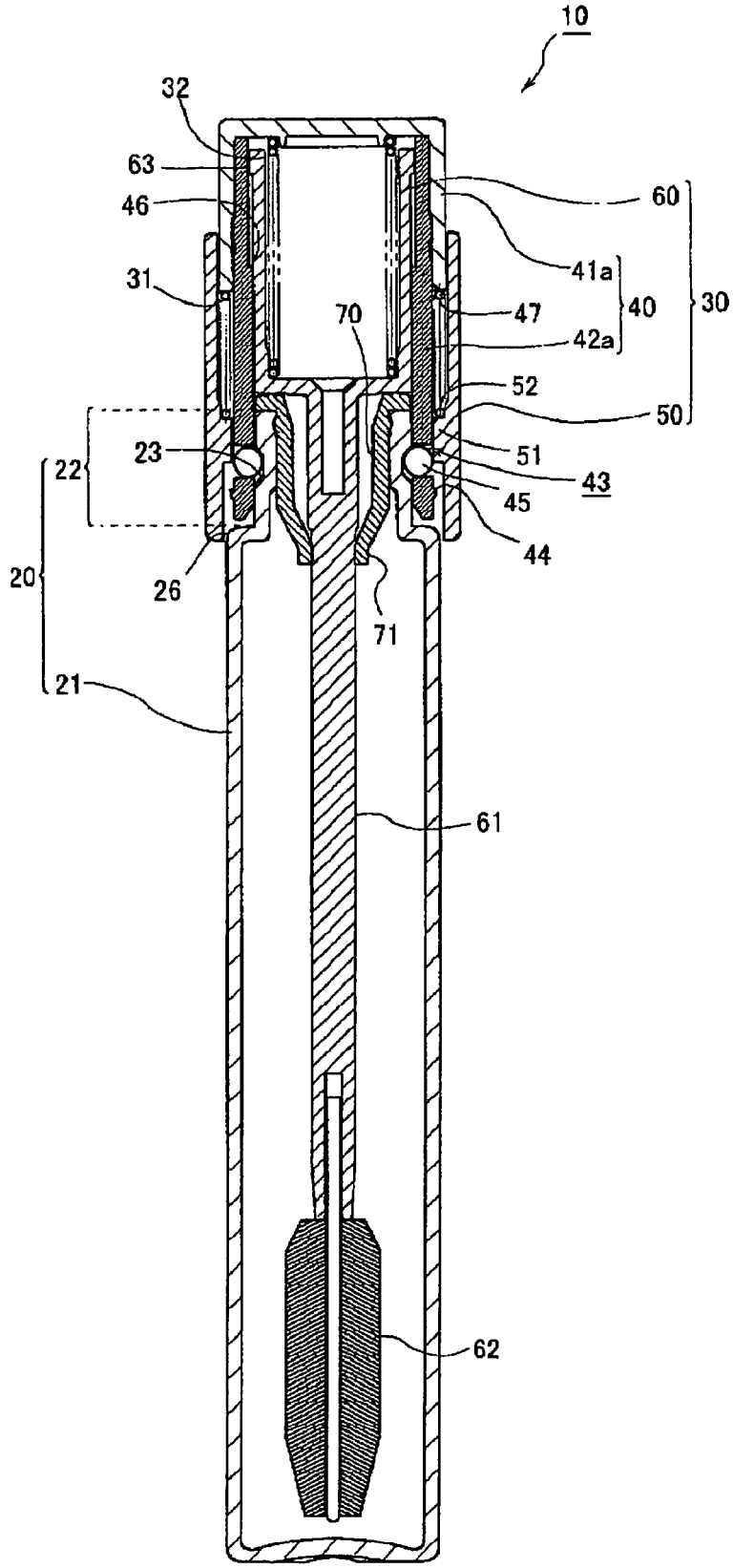
[FIG. 16] A front sectional view showing the cosmetic container in accordance with the second embodiment of the present invention in which the cap is being installed around the container.

Then, as shown in FIG. 14, with the undersurface of the inner tube 60 in contact with the open end of the container body 20, the button 41*a* is further pressed downward against the urging force of the second spring 32. This releases the abutment between the inner peripheral projection 46 and the outer peripheral projection 63 to move the cylinder 42*a* downward relative to the inner tube 60. In the meantime, the locking balls 45 are pressed downward by the restriction projection 51 urged by the first spring 31. Then, upon reaching the position of the engagement groove 23, the locking balls 45 moves inward as shown in FIG. 15 in order to escape from the pressure exerted by the restriction projection 51. Then, the locking balls 45 then fit into the engagement groove 23 as shown in FIG. 16.

Here, since the locking balls 45 that has been prevented from moving downward by the restriction projection 51 has escaped inward, the restriction projection 51 moves further downward rapidly under the urging force of the first spring 31. However, the lower edge of the restriction projection 51 soon abuts against the outer tube stop 44 with a click. Thus, as shown in FIG. 9, the cap 30 is completely installed around the container body 20.

INDUSTRIAL APPLICABILITY

The present invention can be utilized for a container that receives cosmetics such as mascara, manicure, or lip gloss which requires an appropriate amount of the cosmetics to be immersed in an applicator so as to be applied to a desired area.

The invention claimed is:

1. A cosmetic container comprising:

a container body receiving cosmetics inside a shape with an open front end and a closed rear end, having a cylindrical shape at least in the vicinity of the open end, and having an annular engagement groove around an outer periphery of the cylindrical shape, a cap being installed in a covered area extending from the open end of the container body to a predetermined distance rearward including the engagement groove, and a gasket installed between the open end of the container body and the cap;

the cap comprising:

a cap body covering the covered area, an outer tube being externally inserted around the cap body so as to be movable forward and rearward relative to the cap body, a first spring being installed between the cap body and the outer tube to urge the outer tube rearward, an inner tube having an outer diameter smaller than the inner diameter of the cap body, having a closed rear end and an open front end, and being received inside the cap body, a second spring being received inside the inner tube to urge the inner tube rearward and the cap body forward, a shaft section being formed so as to project rearward from the closed end of the inner tube and being received in the container body when the cap body is installed around the covered area, and an application section being provided at a tip of the shaft section and being immersed in the cosmetics when the shaft section is received in the container body;

the cap body having:

a plurality of locking ball reception holes as through-holes formed at positions where the locking ball reception holes align with the engagement groove when the cap body is installed around the covered area, and locking balls as spheres received in the respective locking ball reception holes with a diameter larger than the width of the through-holes in an inner side surface of the cap body;

a restriction projection being provided inside the outer tube as a projection structure corresponding to the locking ball reception holes, restricting outward movement of the locking balls while being urged rearward by the first spring, and releasing the restriction of the outward movement of the locking balls when the outer tube is moved forward against an urging force of the first spring;

an outer peripheral projection being provided on an outer periphery of the inner tube in the vicinity of a tip thereof, projecting outward, and sliding on an inner wall of the cap body; and an inner peripheral projection being provided on an inner periphery of the cap body so as to project inward, being located behind the outer peripheral projection when the cap body is installed around the covered area so as to be locked on the outer peripheral projection when the cap body is moved forward by an urging force of the second spring.

2. The cosmetic container according to claim 1, wherein the locking ball reception holes are longitudinal slots with a length larger than the longitudinal length of the restriction projection.

3. The cosmetic container according to claim 1, wherein an outer peripheral surface of the container body has an almost fixed diameter from the open end to the engagement groove of the container body, and the longitudinal length of the locking ball reception holes is almost equal to the diameter of the locking balls, and a distance between an outer peripheral surface of the inner tube and an inner peripheral surface of the outer tube is almost equal to the diameter of the locking balls at the positions of the locking ball reception holes while the outer peripheral projection and the inner peripheral projection are engaged.

4. The cosmetic container according to claim 3, wherein, when the outer peripheral projection and the inner peripheral projection are engaged, the locking balls are in contact with the outer peripheral surface of the inner tube, the inner peripheral surface of the outer tube, and a rear edge of the restriction projection.

5. The cosmetic container according to claim 4, wherein an outer tube stop as a projection structure on which a rear end of the restriction projection is locked is formed outside and behind the locking ball reception holes in the cap body, and the rear end the restriction projection is locked on the outer tube stop while restricting outward movement of the restriction balls with the cap being installed around the cap body.

* * * * *